US008640282B2

(12) United States Patent
Maguire et al.

(10) Patent No.: US 8,640,282 B2
(45) Date of Patent: Feb. 4, 2014

(54) BED SHEET FOR MULTIPLE LENGTH MATTRESSES

(71) Applicants: Sara Barbara Maguire, Seal Rock, OR (US); Walter Richard Maguire, Seal Rock, OR (US)

(72) Inventors: Sara Barbara Maguire, Seal Rock, OR (US); Walter Richard Maguire, Seal Rock, OR (US)

( * ) Notice: Subject to any disclaimer, the term of this patent is extended or adjusted under 35 U.S.C. 154(b) by 0 days.

(21) Appl. No.: 13/775,012

(22) Filed: Feb. 22, 2013

(65) Prior Publication Data

US 2013/0219617 A1 Aug. 29, 2013

Related U.S. Application Data

(60) Provisional application No. 61/634,060, filed on Feb. 23, 2012.

(51) Int. Cl.
*A47G 9/02* (2006.01)

(52) U.S. Cl.
USPC ..... 5/497; 5/499; 5/496

(58) Field of Classification Search
USPC ..... 5/482, 486, 496, 497, 498, 499
See application file for complete search history.

(56) References Cited

U.S. PATENT DOCUMENTS

| | | | | |
|---|---|---|---|---|
| 3,694,832 | A | 10/1972 | Jamison | |
| 3,868,735 | A | 3/1975 | Ross | |
| 4,672,702 | A * | 6/1987 | Isham | 5/497 |
| 5,127,115 | A * | 7/1992 | Williams et al. | 5/497 |
| 5,173,976 | A | 12/1992 | Jubinville | |
| 5,287,574 | A * | 2/1994 | Kardell et al. | 5/499 |
| 5,636,393 | A * | 6/1997 | Zafiroglu et al. | 5/499 |
| 6,311,525 | B1 | 11/2001 | Marker et al. | |
| 6,532,608 | B2 | 3/2003 | Schreiner | |
| 6,988,283 | B2 * | 1/2006 | Griffin | 5/497 |
| 7,325,263 | B2 * | 2/2008 | Stribling | 5/497 |
| 7,398,570 | B2 * | 7/2008 | Seago | 5/497 |
| 2013/0042411 | A1 * | 2/2013 | Vitale | 5/497 |

* cited by examiner

*Primary Examiner* — Michael Trettel
(74) *Attorney, Agent, or Firm* — Stewart Myers

(57) ABSTRACT

A fitted bed sheet capable of fitting mattresses of multiple lengths is disclosed. The fitted bed sheet has a first section constructed primarily of non-stretch material and a second section sewn to the foot of the first section that is constructed primarily of non-elastic stretch material. The second section stretches to accommodate mattresses of longer lengths thereby eliminating the need to maintain multiple fitted bed sheets. The present invention increases user comfort, can be processed in commercial laundries, reduces the labor of making the bed, is easier to fold, and has a longer useful life than fitted sheets constructed with elastic stretch material. The fitted bed sheet can be washed, ironed, and folded automatically. The present invention may be used in institutional or private settings.

20 Claims, 4 Drawing Sheets

BED SHEET FOR MULTIPLE LENGTH MATTRESSES

CROSS-REFERENCES TO RELATED APPLICATIONS

This application claims priority to U.S. Provisional Patent Application Ser. No. 61/634,060 filed on Feb. 23, 2012 entitled "Advanced Design Bed Sheet—Single Sheet Fits Various Size Mattresses", the disclosure of which is hereby incorporated by reference.

BACKGROUND OF THE INVENTION

1. Field of the Invention

The present invention relates to mattress covers and bedding that are selectively secured over an existing mattress, and more specifically, those designed to fit a plurality of mattress sizes.

2. Background of the Related Art

The use of mattress covers is well known within the related art. Removable washable mattress covers and bedding have been used for centuries as a means of maintaining cleanliness of the mattress being covered. Once the bedding has been soiled, it is then removed and exchanged with the desired replacement bedding. Once removed, the soiled bedding may be cleaned for further use or discarded.

Within the related art, discardable bedding has proven to be economically unreasonable. The use of washable bedding remains the preferred modality within the related art.

The use of size-fit bedding is well known within the related art. When placed onto a mattress, the dimensions of the bedding must be in accordance with the size of the mattress being covered. Generally, the bedding article is larger than the sum of the area of the top of the mattress and the four vertically-supportive sides. Generally, the excess overhanging bedding material of conventional bedding is inwardly tucked under a bed mattress. Alternatively, the bedding can be fashioned as a fitted sheet to snuggly fit and be retained to a mattress using a plurality of corner pockets that engage corresponding corners of the mattress.

Unfortunately, such fit-sized bedding articles are limited to be used upon a correspondingly-sized mattress. As a result of this limitation, the user must inconveniently sort the bedding by size before or after employing them. Such a task is magnified within institutions which employ a large number of mattresses such as, but not limited to, hospitals, hotels, and retirement communities, encompassing a significant number of human hours, and wasted resources. The need to maintain an inventory of multiple-sized bedding units also consumes significant time and space.

In yet another approach, the bedding may include elastic material placed throughout the construction of the bedding. The bedding is then stretched over the mattress causing the elastic material to constrict upon itself under the mattress thereby holding the bedding in place. A disadvantage of utilizing elastic bedding can be seen in the additional weight of each unit. Additional costs of shipping and handling are significant, as well as the added complexity of laundering heavier materials. Furthermore, sanitizing chemicals and the high heat cycles seen in commercial laundering operations can rapidly degrade the elastic fibers resulting in premature replacement of the bedding which subsequently increases costs to the user. Additionally, bedding made with elastic stretch material is notoriously difficult to fold and cannot be ironed due to the heat from the irons irreparably damaging the elastic material. The present invention overcomes those limitations by providing a fitted bed sheet that can be processed in commercial laundry facilities. The present invention can also be washed, have moisture extracted, be ironed and folded automatically without damage to its material.

The quality of individual comfort is considered within the related art. Institutions employing folding beds caution the use of elastic bedding. Upon folding or manipulation of a mattress, elastic bedding will tend to reside in the hypotenuse created by the raised areas of the mattress, effectively lifting the bedding off of the mattress encouraging discomfort to the user, and poor sanitary practices. Secondarily, should the need arise for the bedding to be utilized in the movement of an individual or object, elastic bedding offers little support for weight-bearing tasks.

There is a need for non-elastic, but stretchable, bedding which fits a plurality of mattress sizes and modalities is within the related art.

The present invention meets this need by allowing the user to use one article of non-elastic washable removable bedding on a plurality of mattress sizes.

BRIEF SUMMARY OF THE INVENTION

It is therefore an object of the present invention to provide a fitted bed sheet that fits a plurality of mattress lengths.

It is another object of the present invention to provide a fitted bed sheet that uses non-elastic stretch material to fit a plurality of mattress lengths.

It is still another object of the present invention to provide a fitted bed sheet that reduces per use costs as compared to traditional elastic stretch fabric bed sheets.

It is yet another object of the present invention to provide a fitted bed sheet that has a longer useful life span than traditional elastic stretch fabric bed sheets.

It is still another object of the present invention to provide a fitted bed sheet that reduces the labor costs in institutions and residences that are associated with making, maintaining, and un-making beds.

It is yet another object of the present invention to provide a fitted bed sheet that reduces laundry, and shipping and inventory costs as compared to traditional elastic stretch fabric bed sheets.

It is still another object of the present invention to provide a fitted bed sheet that improves the level of patient care when used in an institutional setting, and elevates the level of comfort for patient and non-patient users.

In accordance with the objects of the invention described above, the present invention provides a fitted bed sheet that can be used with mattresses of various lengths. The fitted bed sheet has a first section that is constructed of conventional cotton, a cotton or polyester percale blend, a muslin sheet material, or any other non-rubberized sheet material suitable. The fitted bed sheet also has a smaller second section that is sewn to the foot of the first section. The second section is constructed of a stretch material comprised of all-cotton, a cotton and polyester blend or knit, materials that are connected by an interlock stitch, or a similar type of non-elastic stretch material. This stretch material is distinguishable from traditional elastic stretch fabrics that are used to manufacture contemporary bed sheets in that the stretch material is non-elastic. Elastic stretch fabric tends to break down more rapidly, cannot be ironed or folded as easily, decreases user comfort, and increases the labor and cost of making beds. The present invention utilizes contour corners at the head and foot of the bed sheet to hold the bed sheet securely to a mattress. The contours allow for increased ease when making a bed. The edges of the first and second sections of the bed sheet are finished using bias binding, overlock stitching, or any other means of finishing edges that ensure a long life. The present invention provides a more functional, cost-effective, and easier-to-use fitted bottom bed sheet for use with a plurality of mattress sizes than what is currently found in the prior art. The present invention overcomes the limitations of the prior art by providing a fitted bed sheet that can be processed in commercial laundry facilities and can be washed, have moisture extracted, be ironed and folded automatically without damage to its material. These advantages are particularly useful to institutions where much of the laundry process is automated in order to reduce person-hour costs.

One exemplary embodiment of the present invention provides a fitted bed sheet for use in an institution such as a hospital or assisted living center. This embodiment of the present invention can fit mattresses of various lengths used in the institution and may increase the level of patient care and comfort.

Another exemplary embodiment of the present invention provides a fitted bed sheet for use in a home, recreational vehicle, or customer accommodation facility such as a hotel or bed-and-breakfast. This embodiment of the present invention can fit mattresses of any length and may increase the level of user or customer comfort.

The preceding brief description is intended to merely outline some objects and advantages of the present invention. The following disclosure will set forth other objects and advantages of the present invention along with novel features that distinguish the present invention from the prior art. It is to be understood that the following disclosure is by no means intended to limit the scope of the present invention or any of its embodiments. It is also to be understood that the accompanying illustrations are presented for descriptive purposes only and similarly are not intended to limit the scope of present invention or any of its embodiments. The following disclosure and accompanying illustrations may describe various features of novelty that characterize the invention. The invention does not reside any particular feature when taken in the singular, but in the combination of features as described herein.

BRIEF DESCRIPTION OF THE SEVERAL VIEWS OF THE IMAGE(S)

DETAILED DESCRIPTION OF THE INVENTION

In the following detailed description, reference is made to the accompanying images that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by appended claims, appropriately interpreted, along with the full range of equivalents to which the claims are entitled.

The word "exemplary" is used herein to mean "serving as an example, instance, or illustration." Any embodiment described herein as "exemplary" is not necessarily to be construed as preferred or advantageous over other embodiments. Likewise, the terms "embodiment(s) of the invention", "alternative embodiment(s)", and "exemplary embodiment(s)" do not require that all embodiments of the method, system, and apparatus include the discussed feature, advantage or mode of operation. The following description of the preferred embodiment is merely exemplary in nature and is in no way intended to limit the invention, its application, or use.

For the purpose of clarity, all like elements will have the same designations in each of the images. The terms "fitted bed sheet", "bed sheet", "present invention", and "invention" may be used interchangeably. In addition to the functions, features, components, and abilities of the apparatus already discussed in this specification, the fitted bed sheet may also have, but not be limited to, the following features contained within the description set forth herein.

Several preferred embodiments of the fitted bed sheet are discussed in this section. However, the invention is not limited to these embodiments. A fitted bed sheet, as according to the present invention, is any item of bedding intended to be used as a fitted bottom sheet with a first section that is made primarily from a non-stretch material, and a second smaller section attached to the first section that is made primarily from a non-elastic stretch material. The fitted bed sheet is not limited in method of operation, dimensions, construction materials, means for securing the second section to the first section, or any other feature appropriate for inclusion as part of a fitted bed sheet.

Figure 1:
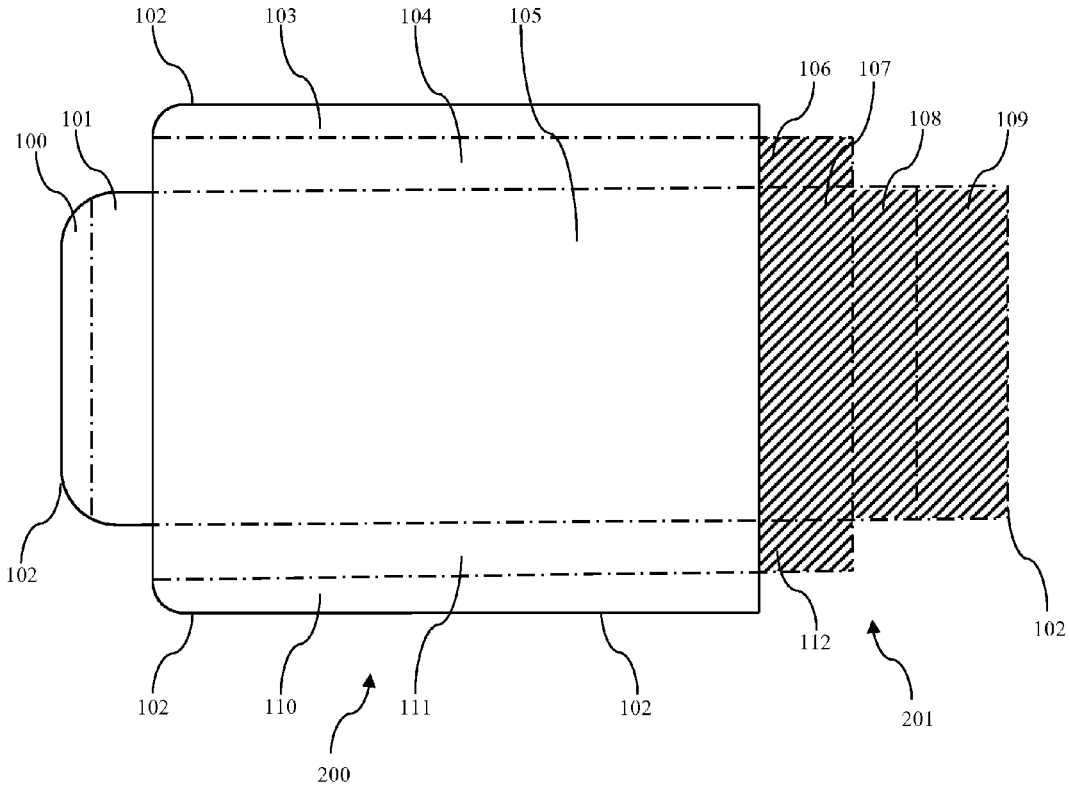
FIG. 1 is a pattern view of a fitted bed sheet as according to one embodiment of the present invention.

Referring now to FIG. 1, there is shown a pattern view of a fitted bed sheet as according to one embodiment of the present invention. The bed sheet comprises a first section (200) constructed primarily of non-stretch material and a second, smaller section (201) attached to the foot of the first section (200) that is constructed primarily of a non-elastic stretch material. Each section (200, 201) is further comprised of several components that, when taken together, fit around various portions of a mattress and secure the fitted bed sheet to the mattress. It is important to note that these components are continuous parts of each section (200, 201) and are referred to in the individual to illustrate the function of that part of the section (200, 201). Referring to parts of each section (200, 201) as individual components does not mean that each component is a separate item that is sewn or otherwise attached to each section (200, 201). Furthermore, when this description refers to components that are adjacent to each other, it is merely referring to the orientation of each component within the first or second section (200, 201) and does not imply that the components are separate items that are sewn together. By way of example, the first section (200) can be manufactured entirely from a single piece of material and shaped so that the single piece of material fits on top of, along the sides, and underneath the mattress. In this description, the area of the first section that rests on top of the mattress is designated as a top component (105), while the areas that cover the right and left side are referred to as the right and left side drop components (104, 111), and so on.

The first section (200) is comprised of a head under mattress component (100) that fits under the head portion of a mattress. The head under mattress component (100) secures the head portion of the fitted bed sheet to the mattress and is adjacent to a head drop component (101). When the invention is in use, the head under mattress component (100) is oriented at an approximate ninety-degree angle to the head drop component (101). The head drop component (101) covers the vertical head-end of the mattress and may be of variable width depending on the thickness of the mattress, where the thickness of the mattress is considered the distance from the top surface of the mattress to the bottom surface of the mattress, and the width of the head drop component (101) directly corresponds to the thickness of the mattress.

The first section has a right under mattress component (103) and a left under mattress component (110). These under mattress components (103, 110) extend from the head of the mattress to near the foot of the mattress. The right and left under mattress components (103, 110) fit under the right and left sides of the mattress and secure the sides of the first section (200) of the fitted sheet to the mattress. The right under mattress component (103) is adjacent to a right side drop component (104) while the left under mattress component (110) is adjacent to a left side drop component (111). When the invention is in use, the right and left under mattress components (103, 110) are oriented at approximately ninety-degree angles to the right and left side drop components (104, 111) and extend the same distance from the head of the mattress along the sides of the mattress as the right and left side under mattress components (103, 110). The right and left side drop components (104, 111) will often cover all or most of the right and left sides of the mattress and may be of variable width depending on the thickness of the mattress. In addition, the right and left side drop components (104, 111) will also cover a small tuck under portion.

A top component (105) rests on the top surface of a mattress. The top component (105) is the area where a patient or user of the invention would lay when in bed or otherwise using the invention. The top component (105) extends equidistance from the head of the mattress as the right and left under mattress components (103, 110) and the right and left side drop components (104, 111). The head drop component (101) is adjacent to the head of the top component (105), and the right and left side drop components (104, 111) are adjacent to the right and left sides, respectively, of the top component (105). Each of the drop components (101, 104, 111) are oriented at approximately ninety-degree angles to the top component (105) when the invention is in use.

The components of the first section (200) are constructed using various grades of conventional cotton, cotton or polyester percale, muslin blends, or other conventional non-stretch materials. All of the outer edges (102) of the first section (200) are finished using bias binding, overlock stitching, or any other means of finishing edges that ensure a long life.

The first section (200) is attached to the second section (201) by sewing, binding, or otherwise securing the two sections together by any means appropriate for a fitted bed sheet. The second section (201) acts as an extendable portion that stretches to accommodate mattresses of varying length. The components of the second section (201) are constructed using non-elastic stretchable materials containing cotton, a cotton and polyester blend, or interlock materials.

The second section (201) is comprised of a second top component (107) that lies within the same plane as the top component (105). A second right side drop component (106) is adjacent to the right side of the second top component (107). A second left side drop component (112) is adjacent to the left side of the second top component (107). When fitted around a mattress, the second right and left side drop components (106, 112) are oriented at an approximately ninety-degree angle to the second top component (107) and extend from the ends of the left and right drop components (104, 111) to the foot of the mattress. The second section (201) further comprises a foot drop component (108) that covers the vertical foot-end of the mattress and may be of variable width depending on the thickness of the mattress. When fitted around a mattress, the foot drop component (108) is oriented at an approximately ninety-degree angle to the second top component (107). The foot drop component (108) is adjacent to the second top component (107) and the second right and left side drop components (106, 112). A foot under mattress component (109) fits under the foot portion of the mattress. The foot under mattress component (109) secures the foot portion of the fitted bed sheet to the mattress and is adjacent to the foot drop component (108). When the invention is in use, the foot under mattress component (108) is oriented at an approximate ninety-degree angle to the foot drop component (108). All of the outer edges (102) of the second section (201) are finished using bias binding, overlock stitching, or any other means of finishing edges that ensure a long life.

The first and second sections (200, 201) are not of the same size. The first section (200) is larger and covers a majority of the mattress to which the fitted sheet is fitted. For purposes of this invention, a majority of the mattress is considered to be more than half of the mattress. The second section (201) is smaller and covers a minority of the mattress. For purposes of this invention, a minority of the mattress is considered to be less than half of the mattress. Similarly, when referring to the top, bottom or the vertical surfaces of the mattress covered by components of the two sections (200, 201), a majority means more than half of the top, bottom, or vertical surface of the mattress. A minority means less than half of the top, bottom, or vertical surface of the mattress.

Figure 2:
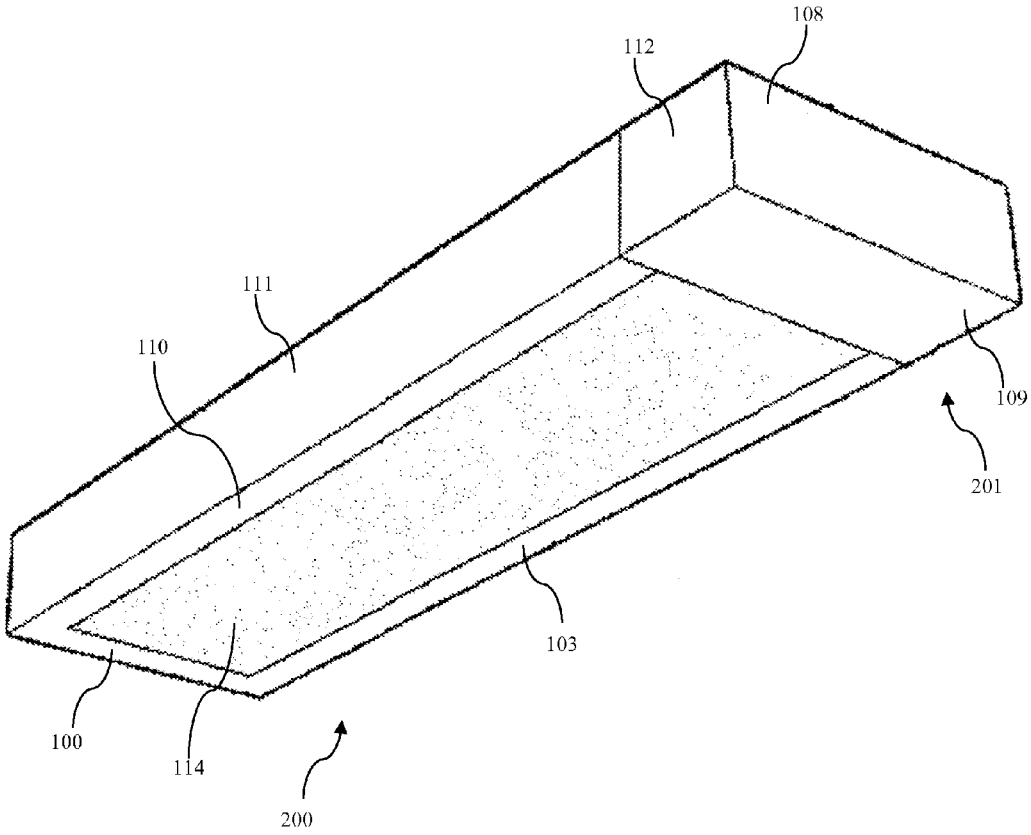
FIG. 2 is a bottom perspective view of a fitted bed sheet fitted to a mattress as according to one embodiment of the present invention.

Referring now to FIG. 2, there is shown a bottom perspective view of a fitted bed sheet fitted to a mattress (114) as according to one embodiment of the present invention. The first section (200) extends from the head of the mattress (114) along the majority of the mattress's (114) length and is attached to the second section (201) near the foot of the mattress (114). Attaching the first section (200) and the second section together (201) is accomplished by sewing, binding, or otherwise securing the two sections together by any means appropriate for a fitted bed sheet.

Components of the first section (200) shown in FIG. 2 include the head under mattress component (100), the right and left under mattress components (103, 110), and the left side drop component (111). The head under mattress component secures the head portion of the fitted bed sheet to the mattress (114). The head under mattress component (100) extends inward from the head toward the foot of the mattress (114). The right and left under mattress components (103, 110) secure the sides of the fitted bed sheet to the mattress (114) and extend inward from the left and right sides of the mattress (114). The right and left under mattress components (103, 110) are adjacent to the foot under mattress component (109) near the foot of the bed. The left side drop component (111) is fitted around a majority of the left side of the mattress (114) and extends from the head to near the foot of the mattress (114). The left side drop component (111) is adjacent to the left under mattress component (110) and the second left side drop component (112).

Components of the second section (201) shown in FIG. 2 include the foot drop component (108), the foot under mattress component (109), and the second left side drop component (112). The foot drop component (108) is fitted around the foot of the mattress (114) and is adjacent to the foot under mattress component (109) and the left side drop component (112). The foot under mattress component (109) secures the foot portion of the fitted bed sheet to the mattress and extends inward from the foot to the head of the mattress (114). The second left side drop component (112) is fitted around a lesser portion of the left side of the mattress (114) than the left side drop component (111) and is adjacent to the left side drop component (111), the foot drop component (108), and the foot under mattress component (109).

Figure 3:
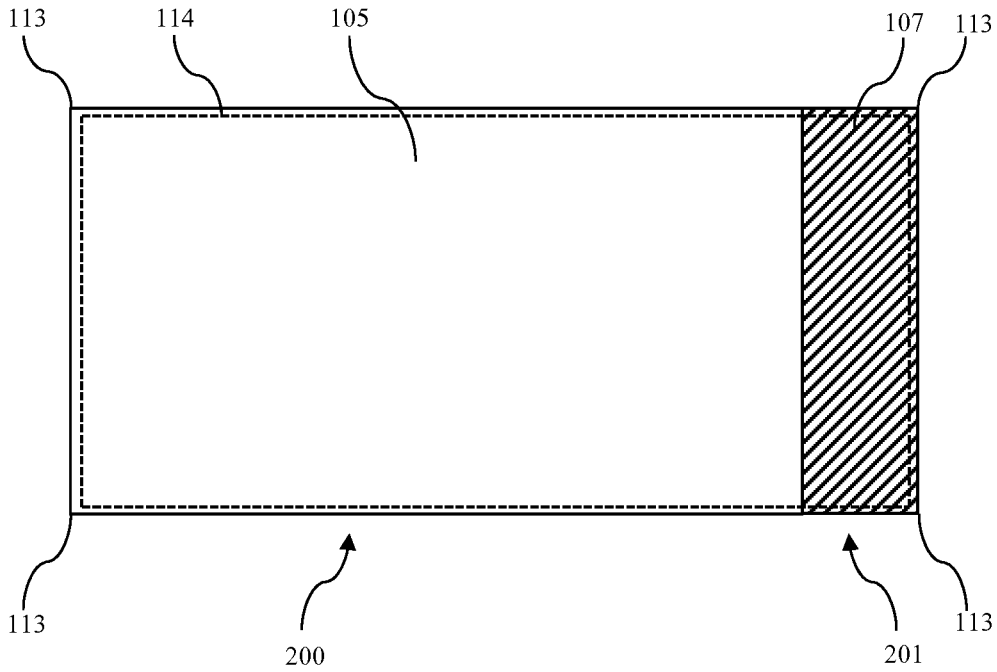
FIG. 3 is a top view of a fitted bed sheet fitted to a mattress of a shorter length as according to one embodiment of the present invention.

Referring now to FIG. 3, there is shown a top view of a fitted bed sheet fitted to a mattress (114) of a shorter length as according to one embodiment of the present invention. The top component (105) of the first section covers most of the top portion of the mattress (114). The second top component (107) of the second section (201) covers the foot portion of the mattress (114). In the configuration shown in this figure, the second section (201) is in a relatively relaxed state and is not significantly stretched to extend over the foot section of the mattress (114).

Both the first section (200) and the second section (201) have contour corners (113) at the head and foot of the mattress (114) to hold the fitted sheet securely to the mattress (114). The contour corners (113) allow for ease in making up the bed and in stripping the bed.

Figure 4:
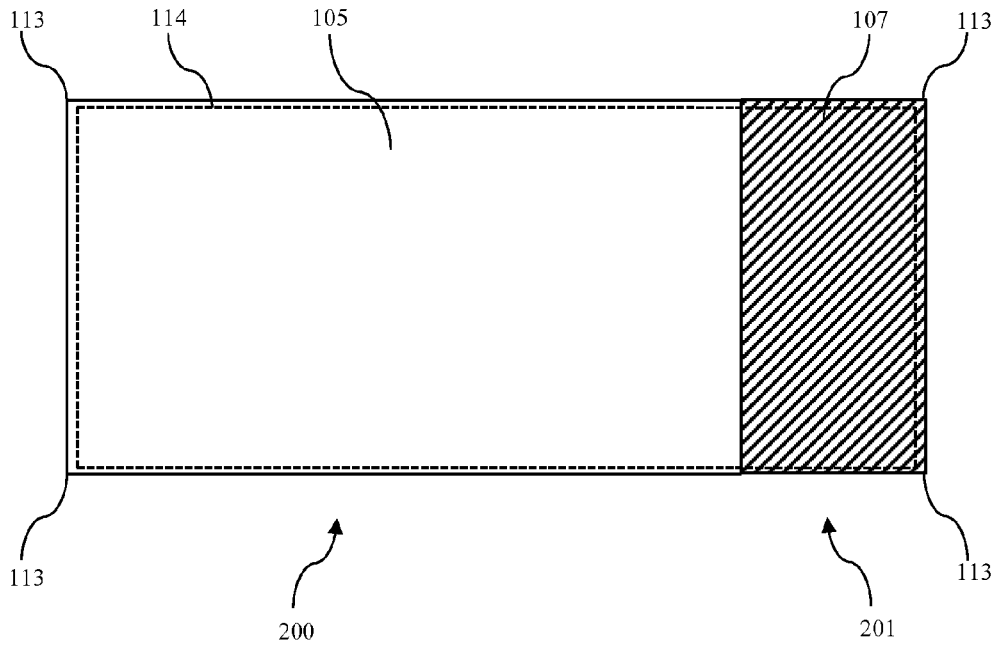
FIG. 4 is a top view of a fitted bed sheet fitted to a mattress of a longer length as according to one embodiment of the present invention.

Referring now to FIG. 4, there is shown a top view of a fitted bed sheet fitted to a mattress (114) of a longer length as according to one embodiment of the present invention. The top component (105) of the first section covers the same amount of the top portion of the mattress (114) as shown in FIG. 3, but now the second section (201) has stretched to cover a larger area of the foot portion of the mattress (114). In the configuration shown in this figure, the second section (201) is in a stretched state and has extended to cover the foot section of the mattress (114). By stretching to cover the foot section of the mattress (114), the second section (201) allows for mattresses of varying length to be used with the present invention.

As set forth in this description and the attached images, an improved fitted bed sheet has been developed that improves upon conventional elastic stretch fabric bed sheets. The various embodiments of the improved fitted bed sheet described herein can be used in a wide variety of applications.

In one preferred embodiment of the present invention, a fitted bed sheet is particularly well-adapted for use in an institution. Institutions commonly make use of numerous mattresses, many of which are of varying size or length. An institution can include, but is not limited to, hospitals, retirement communities, or assisted living facilities. Any organization that utilizes a patient-caregiver relationship can be considered an institution for purposes of the present invention. When providing care for patients, bedding comfort and sanitation is a primary concern. A significant number of human hours are devoted to changing patient's bedding. This embodiment of the present invention reduces the need to purchase and store multiple-sized bedding, and increases the ease of changing a patient's bedding.

In another preferred embodiment of the present invention, a fitted bed sheet is particularly well-adapted for use in a non-institution setting. This embodiment may be used in a home, recreational vehicle, hotel, motel, bed and breakfast, hostel, or with any other bed that is not in an institution. This embodiment of the present invention allows a homeowner, motel staff, or other non-institutional person to possess less substitute bedding, and to experience greater longevity of the fitted bed sheet compared to bed sheets constructed with non-elastic stretch material. Furthermore, the present invention provides for constant fit in all mattress positions.

The preceding exemplary embodiments are not intended to be limiting, but are merely illustrative for the possible uses of the fitted bed sheet.

Although certain example methods, apparatus and articles of manufacture have been described herein, the scope of coverage of this patent is not limited thereto. On the contrary, this patent covers all methods, apparatus and articles of manufacture fairly falling within the scope of the invention either literally or under the doctrine of equivalents.

With respect to the above description then, it is to be realized that the optimum dimensional relationships for the parts of the fitted bed sheet, to include variations in size, materials, shape, form, function and the manner of operation, and use, are deemed readily apparent and obvious to one skilled in the art, and all equivalent relationships to those illustrated in the images and described in the specification are intended to be encompassed by the fitted bed sheet.

Directional terms such as "front", "back", "in", "out", "downward", "upper", "lower", "top", "bottom", and the like have been used in the description. These terms are applicable to the embodiments shown and described in conjunction with the images. These terms are merely used for the purpose of description in connection with the images and do not necessarily apply to the position in which the fitted bed sheet may be used.

Therefore, the foregoing is considered as illustrative only of the principles of the fitted bed sheet. Further, since numerous modifications and changes will readily occur to those skilled in the art, it is not desired to limit the fitted bed sheet to the exact construction and operation shown and described, and accordingly, all suitable modifications and equivalents may be resorted to, falling within the scope of the fitted bed sheet. While the above description describes various embodiments of the present invention, it will be clear that the present invention may be otherwise easily adapted to fit any configuration where a fitted bed sheet is desired or required.

As various changes could be made in the above constructions without departing from the scope of the invention, it is intended that all matter contained in the above description or shown in the accompanying images shall be interpreted as illustrative and not in a limiting sense.

What is claimed is:

1. A fitted bed sheet for use with a substantially rectangular mattress comprising:

a first section constructed primarily of a non-stretch material where the first section has a top component that rests on the top of the mattress, a head under mattress component that fits under the head of the mattress, a head drop component that covers the vertical head surface of the mattress, right and left under mattress components that fit under the right and left sides of the mattress, and right and left side drop components that cover a majority of the right and left sides of the mattress; a second section constructed primarily of non-elastic stretch material where the second section has a second top component that rests on top of the mattress, second right and left side drop components that cover a minority of the right and left sides of the mattress, a foot under mattress component that fits under the foot of the mattress, and a foot drop component that covers the vertical foot surface of the mattress.

2. The fitted bed sheet of claim 1, wherein the non-stretch material is a grade of conventional cotton, a cotton or polyester percale, a cotton and polyester blend, or a muslin blend.

3. The fitted bed sheet of claim 1, wherein the head under mattress component is adjacent to the head drop component.

4. The fitted bed sheet of claim 1, wherein the right and left under mattress components are adjacent to the right and left side drop components, respectively.

5. The fitted bed sheet of claim 1, wherein the non-elastic stretch material is non-elastic and contains cotton, a cotton and polyester knit, or interlock materials.

6. The fitted bed sheet of claim 1, wherein the first and second sections are attached by sewing or binding.

7. The fitted bed sheet of claim 1, wherein all the outer edges of the fitted bed sheet are finished using bias binding, sewing, or overlock stitching.

8. A method for fitting a bed sheet to a substantially rectangular mattress comprising:

providing a first section of a bed sheet that is constructed primarily of non-stretch material and covers a majority of the mattress; providing a second section of the bed sheet that is constructed primarily of non-elastic stretch material that stretches to accommodate mattresses of increased length and covers less of the mattress than the first section; attaching the first section of the bed sheet to the second section of the bed sheet; providing components of the first section of the bed sheet that secure the first section of the bed sheet to the mattress by covering the vertical head surface of the mattress, a majority of the right vertical side of the mattress, a majority of the left vertical side of the mattress, and a portion under the head and right and left sides of the mattress; providing components of the second section that secure the second section of the bed sheet to the mattress by covering the vertical foot surface of the mattress, a minority of the right vertical side of the mattress, and a minority of the left vertical side of the mattress; and providing a component of the second section of the bed sheet that fits under the foot of the mattress.

9. The method of claim 8, wherein the non-stretch material is a grade of conventional cotton, a cotton or polyester percale, a cotton and polyester blend, or a muslin blend.

10. The method of claim 8, wherein the majority of the mattress covered by the first section is a portion of the mattress extending from the head of the mattress and terminating past the midpoint of the mattress.

11. The method of claim 8, wherein the non-elastic stretch material contains cotton, a cotton and polyester knit, or interlock materials.

12. The method of claim 8, wherein the first section and the second section are attached by sewing or binding.

13. The method of claim 8, further comprising finishing the outer edges of the first section and the second section by bias binding, sewing, rolled hem, or overlock stitching.

14. An article of bedding for use with mattresses of multiple lengths comprising:

a fitted bed sheet with a first section that covers a majority of a mattress and does not stretch, a second section composed primarily of non-elastic stretch material attached to the first section that covers a minority of the mattress and varies in length by stretching to accommodate longer mattresses, components of the first section that wrap around the head and a majority of the sides of the mattress, components of the first section that secure the first section to the mattress by wrapping around a portion of the bottom of the mattress, components of the second section that wrap around the foot and a minority of the sides of the mattress, and components of the second section that secure the second section to the mattress by wrapping around a portion of the bottom of the mattress.

15. The article of bedding of claim 14, wherein the first section is constructed primarily from a grade of conventional cotton, a cotton or polyester percale, a cotton and polyester blend, or a muslin blend.

16. The article of bedding of claim 14, wherein the non-elastic stretch material is cotton, a cotton and polyester knit, or interlock materials.

17. The article of bedding of claim 14, wherein the first section and the second section are attached by sewing or binding.

18. The article of bedding of claim 14, wherein the components of the first section that wrap around the head and a majority of the sides of the mattress connect to the components of the second section that wrap around the foot and a minority of the sides of the mattress.

19. The article of bedding of claim 14, wherein the components of the first section that wrap around a portion of the bottom of the mattress connect to the components of the second section that wrap around a portion of the bottom of the mattress.

20. The article of bedding of claim 14, wherein the outer edges of the first section and the second section are finished by bias binding, sewing, rolled hem, or overlock stitching.

* * * * *